US009587909B1

(12) United States Patent
Askin et al.

(10) Patent No.: US 9,587,909 B1
(45) Date of Patent: Mar. 7, 2017

(54) MODULAR DISRUPTER CANNON

(71) Applicant: Department of the Navy, Washington, DC (US)

(72) Inventors: Dennis Askin, King George, VA (US); Lee Foltz, Indian Head, MD (US); David Rivera Marchand, Alexandria, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/999,439

(22) Filed: May 6, 2016

(51) Int. Cl.
*F41B 9/00* (2006.01)
*F41F 1/00* (2006.01)

(52) U.S. Cl.
CPC ..... *F41F 1/00* (2013.01); *F41B 9/0046* (2013.01)

(58) Field of Classification Search
CPC ..... F41B 9/0046; F42B 33/06
USPC ..... 86/50; 89/1.13; 42/77
See application file for complete search history.

(56) References Cited

U.S. PATENT DOCUMENTS 5,460,154 A 10/1995 Mattern et al.
5,743,246 A 4/1998 Mattern
7,481,146 B2 1/2009 Weiss
8,245,430 B1 8/2012 Owenby et al.
8,276,495 B1 10/2012 Chiu et al.
8,833,223 B1 9/2014 Do et al.
2003/0047062 A1* 3/2003 Alexander ..... F41B 11/00 86/50
2005/0081706 A1* 4/2005 Alford ..... F42B 33/062 89/1.13
2009/0178548 A1* 7/2009 Tyas ..... F41B 9/0046 86/50
2016/0169614 A1* 6/2016 Dey ..... F41A 1/10 86/50

FOREIGN PATENT DOCUMENTS

GB 2473808 B * 1/2013 ..... F42B 33/06

* cited by examiner

*Primary Examiner* — Reginald Tillman, Jr.
(74) *Attorney, Agent, or Firm* — Fredric J. Zimmerman

(57) ABSTRACT

A modular disruptor cannon includes three open-ended tubular structures. A first tubular housing defines a first interior region longitudinally aligned with a second interior region. The first tubular housing has external-surface threads at a first end thereof adjacent to the second interior region. A tubular insert is fitted in the second interior region. A second tubular housing defines a cap longitudinally aligned with a barrel. The barrel has an inside diameter equal to the inside diameter of the tubular insert. The cap has internal-surface threads for mating with the external-surface threads of the first tubular housing where the barrel is longitudinally aligned with the tubular insert.

9 Claims, 2 Drawing Sheets

MODULAR DISRUPTER CANNON

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to dearmer barrels, and more particularly to a modular arrangement of tubular housings for configuration as a disruptor cannon.

BACKGROUND. OF THE INVENTION

Dearmer tools (or simply dearmers) are devices used to launch projectiles at unexploded ordnance or munitions in order to detonate or neutralize the ordnance/munitions. Some simple dearmers are propellant driven systems in which a dearmer barrel houses a conventional ordnance round and a projectile that is expelled from the dearmer barrel when the round is fired. For example, FIG. 1 illustrates a cross-section of a conventional MK-2 dearmer 10 that supports a .50 caliber round in a first tubular region 12 and a one inch diameter projectile in a second tubular region 14. However, the MK-2 dearmer is limited in terms of the size of projectile that may be used and the generated projectile velocities.

SUMMARY OF THE INVENTION

Accordingly, it is an object of the present invention to provide a versatile dearmer.

Another object of the present invention is to provide modular elements that can be configured to define a more versatile dearmer.

Other objects and advantages of the present invention will become more obvious hereinafter in the specification and drawings.

In accordance with the present invention, a modular disruptor cannon includes an open-ended first tubular housing defining a first interior region longitudinally aligned with a second interior region. The first tubular housing has external-surface threads at a first end thereof adjacent to the second interior region. An open-ended tubular insert is fitted in the second interior region where an inside diameter of the tubular insert is defined. An open-ended second tubular housing defines an open-ended cap longitudinally aligned with an open-ended barrel. The barrel has an inside diameter equal to the inside diameter of the tubular insert. The cap has internal-surface threads for mating with the external-surface threads of the first tubular housing where the barrel is longitudinally aligned with the tubular insert.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
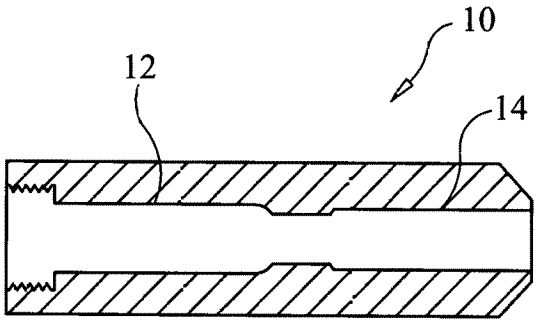
FIG. 1 PRIOR ART
FIG. 1 is a cross-sectional view of a conventional MK-2 dearmer.
Figure 2:
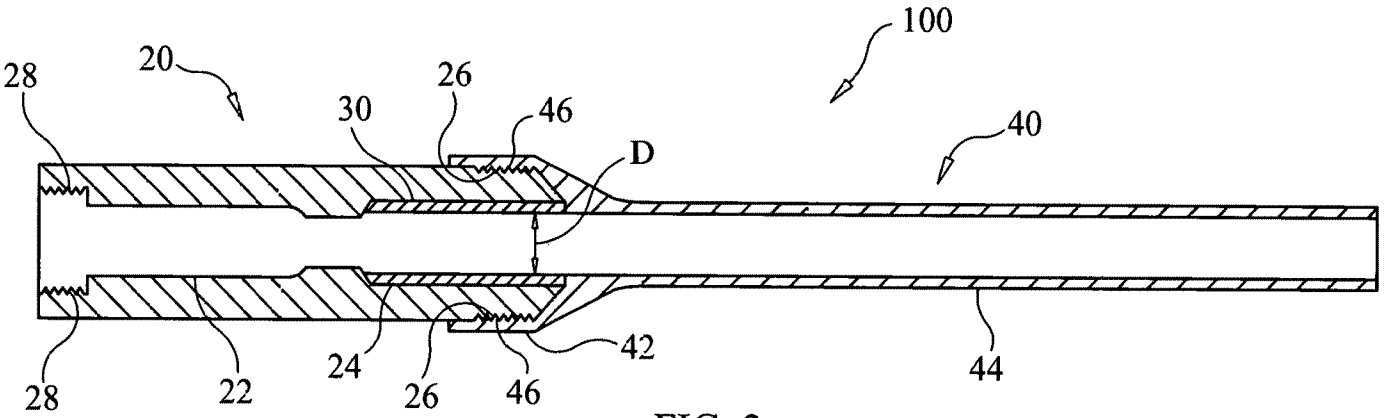
FIG. 2 is a cross-sectional view of a modular disruptor cannon in accordance with an exemplary embodiment of the present invention.

Referring now to the drawings and more particularly to FIG. 2, a modular disruptor cannon in accordance with an exemplary embodiment of the present invention is shown and is referenced generally by numeral 100. Cannon 100 includes three basic elements that serve as the building block for additional configurations, some of which will be explained further below.

In general, modular disruptor cannon 100 includes three open-ended tubular structures 20, 30 and 40 to define internal regions that support a conventional ordnance round and a projectile that is to be forcefully expelled from cannon 100. A first open-ended tubular structure 20 defines two longitudinally-aligned regions 22 and 24. Region 22 is sized/shaped to house a conventional ordnance round. For example, if tubular structure 20 is based on the MK-2 dearmer, region 22 is sized/shaped to house a .50 caliber round (not shown) and region 24 is sized/shaped to house a one inch diameter projectile (not shown). One end of tubular structure 20 adjacent to region 24 has threads 26 formed on its exterior surface.

A second open-ended tubular structure 30 is sized to fit in region 24 of tubular structure 20. The inside diameter "D" of tubular structure 30 is, therefore, less than the inside diameter of region 24. That is, tubular structure 30 may accommodate a smaller diameter projectile (not shown) than region 24.

A third open-ended tubular structure 40 is coupled to the end of tubular structure 20 that is adjacent to region 24. More specifically, tubular structure 40 defines a cap portion 42 and a barrel portion 44 longitudinally aligned with cap portion 42. Cap portion 42 has threads 46 formed at the cap's internal surface that mate with threads 26 of tubular structure 20 such that barrel portion 44 is in longitudinal alignment with tubular structure 30. Barrel portion 44 defines a constant internal diameter that is equal to the inside diameter D of tubular structure 30. As a result, the inside portions of tubular structure 30 and barrel portion 44 define a constant diameter tube along their combined length.

Figure 3:
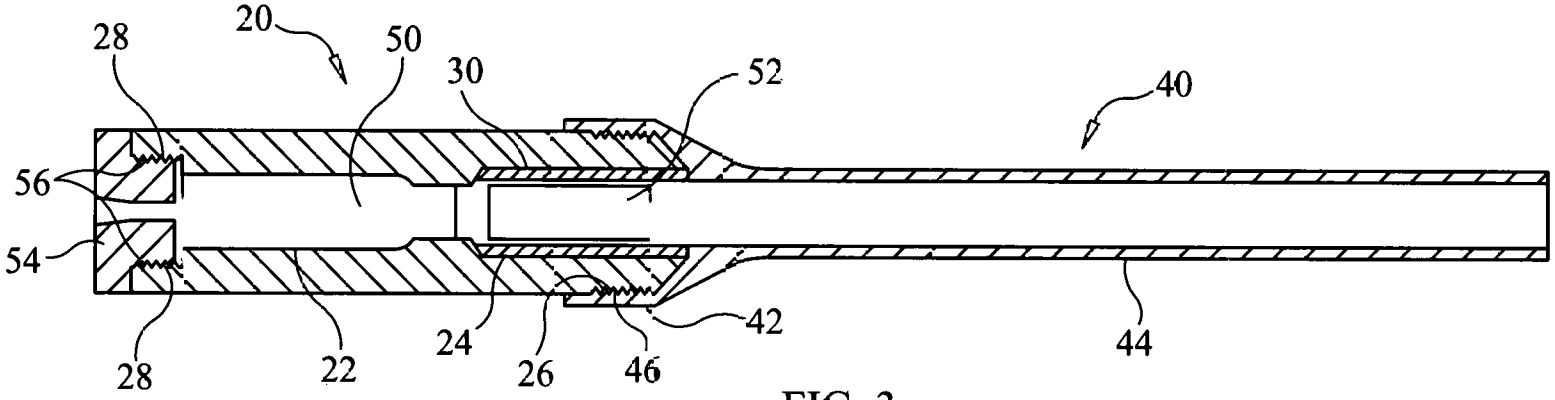
FIG. 3 is a cross-sectional view of the modular disruptor cannon housing a .50 caliber round and projectile in accordance with an exemplary embodiment of the present invention.

As mentioned above, tubular structure 20 may be based on the MK-2 dearmer. By way of an illustrative example, a modular disruptor cannon completed using an MK-2 dearmer as the basis for tubular structure 20 is shown in FIG. 3 where common reference numerals are used for elements described previously herein. A conventional .50 caliber round 50 is fitted in region 22 and a projectile/slug 52 is fitted in tubular structure 30. A breech plug 54 having external threads 56 formed thereon mate with internal threads 28 of tubular structure 20 that already exist on an MK-2 dearmer.

Figure 4:
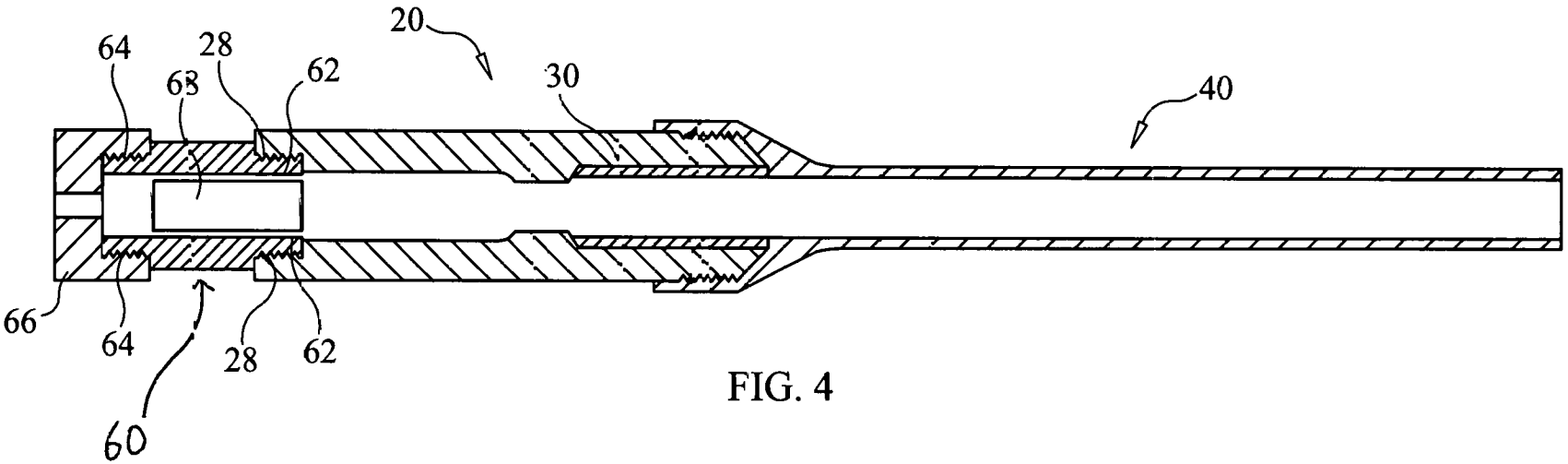
FIG. 4 is a cross-sectional view of the modular disruptor cannon housing a 12 gauge round in accordance with another exemplary embodiment of the present invention.

The basic three tubular structures 20, 30, and 40 may also form the basis for other disruptor cannon embodiments. For example, FIG. 4 illustrates another disruptor cannon in which tubular structure 20 is based on the MK-2 dearmer as described above and a tubular adapter 60 is externally threaded at 62 to mate with internal threads 28 on tubular structure 20. Tubular adapter 60 is also threaded externally at 64 to mate with a breech cap 66. Tubular adapter 60 is sized/shaped to receive a conventional 12 gauge round 68. Note that the single-tube adapter 60 may be replaced with a multi-tube adapter (e.g., two tubes joined at the base of a "V", three tubes joint at a common base, etc.) to allow the use of multiple 12 gauge rounds to produce a higher projectile velocity.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. A modular disruptor cannon, comprising:

an open-ended first tubular housing defining a first interior region longitudinally being aligned with a second interior region, said first tubular housing includes external-surface threads at a first end thereof adjacent to said second interior region;

an ordnance round being fitted in said first interior region;

an open-ended tubular insert being fitted in said second interior region, wherein an inside diameter of said tubular insert is defined; and an open-ended second tubular housing defining an open-ended cap longitudinally being aligned with an open-ended barrel, said barrel includes an inside diameter equal to said inside diameter of said tubular insert, said cap includes internal-surface threads for mating with said external-surface threads of said first tubular housing, wherein said barrel is longitudinally aligned with said tubular insert.

2. The modular disruptor cannon as in claim 1, wherein said first tubular housing includes internal-surface threads defined at a second end thereof adjacent to said first interior region.

3. The modular disruptor cannon as in claim 2, further comprising an externally-threaded attachment for mating with said internal-surface threads of said first tubular housing.

4. The modular disruptor cannon as in claim 1, wherein said ordnance round comprises a .50 caliber round.

5. A modular disruptor cannon, comprising:

an MK-2 dearmer barrel defining a first interior region longitudinally being aligned with a second interior region, said dearmer barrel includes external-surface threads at a first end thereof adjacent to said second interior region;

an ordnance round being fitted in said first interior region;

an open-ended tubular insert being fitted in said second interior region, wherein an inside diameter of said tubular insert is defined; and an open-ended tubular housing defining an open-ended cap longitudinally being aligned with an open-ended barrel extension, said barrel extension includes an inside diameter equal to said inside diameter of said tubular insert, said cap includes internal-surface threads for mating with said external-surface threads of said dearmer barrel, wherein one end of said tubular insert abuts one end of said barrel extension, and wherein said barrel extension is longitudinally aligned with said tubular insert.

6. The modular disruptor cannon as in claim 5, wherein said dearmer barrel includes internal-surface threads defined at a second end thereof adjacent to said first interior region.

7. The modular disruptor cannon as in claim 6, further comprising an externally-threaded attachment for mating with said internal-surface threads of said dearmer barrel.

8. The modular disruptor cannon as in claim 5, further comprising a .50 caliber round being fitted in said first interior region of said dearmer barrel.

9. The modular disruptor cannon as in claim 8, further comprising a projectile being positioned in said tubular insert.

* * * * *